US006807130B2

(12) United States Patent
Terzian

(10) Patent No.: US 6,807,130 B2
(45) Date of Patent: Oct. 19, 2004

(54) SELECTIVE PROMPTS FOR SETTING OR RESETTING DIGITAL TIME DISPLAYS

(75) Inventor: Berj A. Terzian, Newbury, MA (US)

(73) Assignee: Equitime, Inc., Newbury, MA (US)

( * ) Notice: Subject to any disclaimer, the term of this patent is extended or adjusted under 35 U.S.C. 154(b) by 0 days.

(21) Appl. No.: 10/356,889

(22) Filed: Feb. 3, 2003

(65) Prior Publication Data

US 2004/0151075 A1 Aug. 5, 2004

(51) Int. Cl.[7] ..... G04C 17/00; G04C 19/00; G04B 19/00

(52) U.S. Cl. ..... 368/239; 368/69; 368/71; 368/223

(58) Field of Search ..... 368/69–71, 107–113, 368/82–84, 223–238, 240

(56) References Cited

U.S. PATENT DOCUMENTS 4,271,497 A 6/1981 Terzian
4,354,260 A * 10/1982 Planzo ..... 368/10
4,627,737 A * 12/1986 Nance et al. ..... 368/239
4,887,249 A * 12/1989 Thinesen ..... 368/10
5,343,446 A * 8/1994 Simmons et al. ..... 368/251
6,215,736 B1 4/2001 Terzian

FOREIGN PATENT DOCUMENTS

GB 2028547 * 3/1980 ..... 368/84

* cited by examiner

*Primary Examiner*—Randy Gibson
*Assistant Examiner*—Michael L. Lindinger

(57) ABSTRACT

Real time balanced, quadribalanced, enhanced quadribalanced or unidirectional segmented digital time display systems are modified by inclusion of selectively prompted displays which are readily visually distinguishable from the real time displays and which prompt the viewer with the letters T, A and d to comprehend that the displays are in modes that enable and thus facilitate the setting or resetting of current real time, an alarm time or calendar values.

17 Claims, 3 Drawing Sheets

SELECTIVE PROMPTS FOR SETTING OR RESETTING DIGITAL TIME DISPLAYS

BACKGROUND OF THE INVENTION

1. Field of the Invention

This invention relates to timekeeping and, more particularly, to the creation of prompts to facilitate the setting or resetting and the use of digital time displays for general purpose timekeeping, as most individuals customarily employ while conducting their daily activities within desired time schedules or requirements.

2. Description of the Prior Art

Balanced, quadribalanced and enhanced quadribalanced digital time displays are disclosed in the prior art. Examples of patents which describe such displays include U.S. Pat. No. 4,627,737, U.S. Pat. No. 4,271,497 and U.S. Pat. No. 6,215,736 B1, the disclosures of which are incorporated herein by reference. These displays have a common characteristic, which is that at the conclusion of the first half of each hour, the time information transitions from elapsed time to remaining time.

More specifically, during the first half hour, the current hour in these displays is flanked on its right side by incrementing elapsed minutes in a single or dual up/down position. Thereafter the hour value increases by one to display the forthcoming next hour, minutes switch to a single or dual down/up position flanking the left side of the next hour and begin counting down the remaining minutes before the commencement of the next hour. An optional display of seconds counting up from zero to 59 during each elapsed minute and counting down from 59 to zero during each remaining minute also can be included.

3. Recognition of Problems in the Prior Art

As a result of the above-described characteristics of the three types of prior art displays, only the digital hour and seconds displays thereof remain in a stationary position, while digital minutes move in repetitive right to left flanking positions around the centrally displayed hours in rotary-like motions from hour to hour.

Because such displays occupy a larger area of the overall display field than conventional digital displays, there is a question as to whether or how such area should be modified when switching from a real time mode to a setting mode in order to set or reset real or alarm times. Another consideration is whether or how to include cues or prompts in the converted displays in order to provide differentiation between the real time displays and either the real time or alarm time setting modes.

Such cues or prompts should have singular characteristics which not only differentiate between real time and the setting or resetting of real time or alarm time, but also between the setting of either of such time values and the setting of calendar values such as day names and the dates of a current month, day and year.

Ideally, through the aid of effective prompts, the viewer should immediately become aware of which values are available for setting or resetting with utmost clarity and comprehension, so that there is little or no uncertainty or confusion, thereby minimizing or avoiding the risk of error or failure.

SUMMARY OF THE INVENTION

The present invention provides several modes of visual prompts, each having singular characteristics such that a viewer is immediately informed that a setting or resetting mode has been activated for the setting or resetting of, respectively, real time values, calendar values and alarm time values in a balanced type of digital time display. The use of such prompts facilitates the setting or resetting of such time and calendar sequences with maximum clarity and certainty so that the viewer is assured of being able to comprehend what is under way during any one of such setting or resetting procedures.

This is especially useful for the balanced, quadribalanced and enhanced quadribalanced displays of the prior art because those displays normally leave one-half or three quarters of the display area reserved for digital minutes without time information during the course of each hour. This condition is substantially contrasted by the present invention which, during the improved setting modes, not only fills substantially the entire display area with prompts, but also generates appearances which are immediately distinguishable from the usual real time appearances. Such visual differentiation between the real time displays and the setting or resetting time displays further facilitates performing the latter without confusion or error.

An important advantage of these features is that both the prompted real time and alarm time setting modes can be, and preferably are, always displayed in terms of elapsed minutes and seconds past a current hour, regardless of the specific point at which one or the other of these modes is accessed during the course of an hour. Therefore, when the real time setting mode is activated during the second half of an hour, the resulting automatic transition from remaining minutes and seconds until a next hour to equivalent elapsed minutes and seconds past a current hour enables consulting exact time announcements provided by telephone, television, radio, etc., which are likewise invariably given in elapsed time, to readily synchronize and thereby set or reset the display to the announced time. Thus, the potentially difficult mental conversion of a remaining time display to a corresponding equivalent announced elapsed time during a second half hour setting or resetting procedure is avoided and eliminated by the present invention.

Similar advantages are achieved by the prompted alarm time setting or resetting mode provided by the invention. By designing this mode to be in the same elapsed time format and content as the prompted real time setting mode, setting or resetting the minutes and hour of a desired alarm time during the second half hour, by mental conversion of such desired alarm time to equivalent remaining time, is also avoided. In addition, the similarity of the alarm setting mode to the real time setting mode and the distinct difference in appearance of such modes from a balanced real time display provides a coordinated consistency of the setting functions and differentiation thereof from the real time display, thus enhancing a viewer's complete comprehension of these respective functions.

Other features and details of the invention will be understood from the ensuing specific description read in connection with the drawings.

DESCRIPTION OF THE PREFERRED EMBODIMENT

As earlier noted, in the previously cited balanced and quadribalanced digital time displays, minute digits flank alternate sides of centrally positioned hour displays, first on the right during the first half hour and thereafter on the left during the second half hour. The same is true for similar displays described in co-pending application Ser. No. 10/340,304, entitled Unidirectional Segmented Digital Time Displays, now U.S. Pat. No. 6,584,041.

Figure 1:
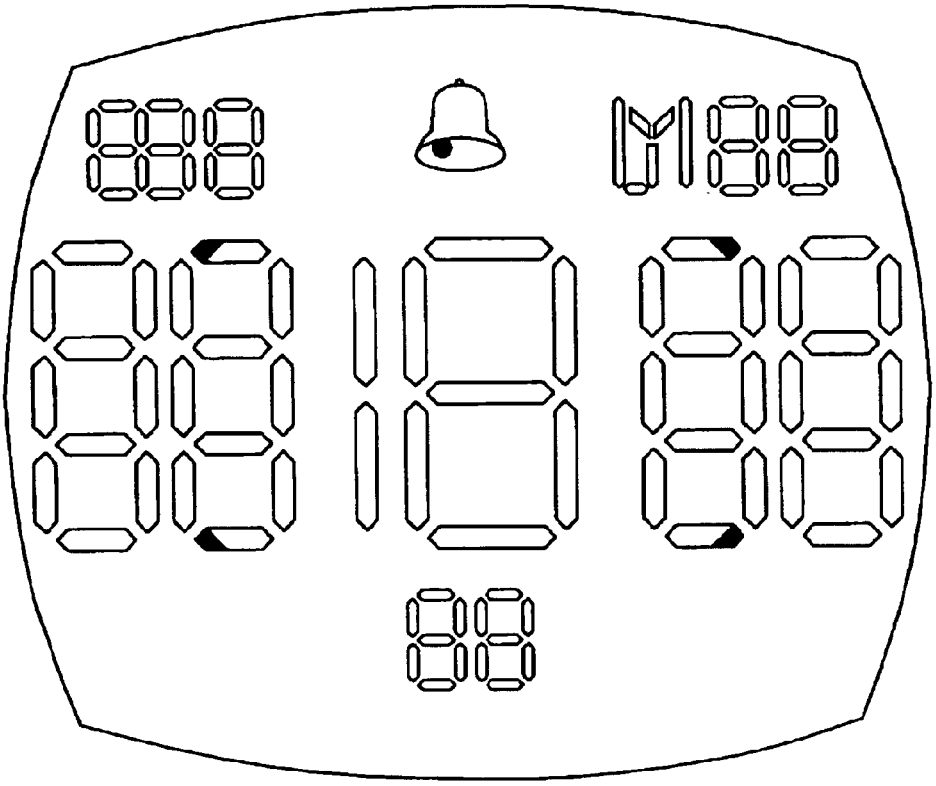
FIG. 1 is a layout drawing of digital display elements that is similar to FIG. 1 of U.S. Pat. No. 6,215,736 B1.
Figure 2:
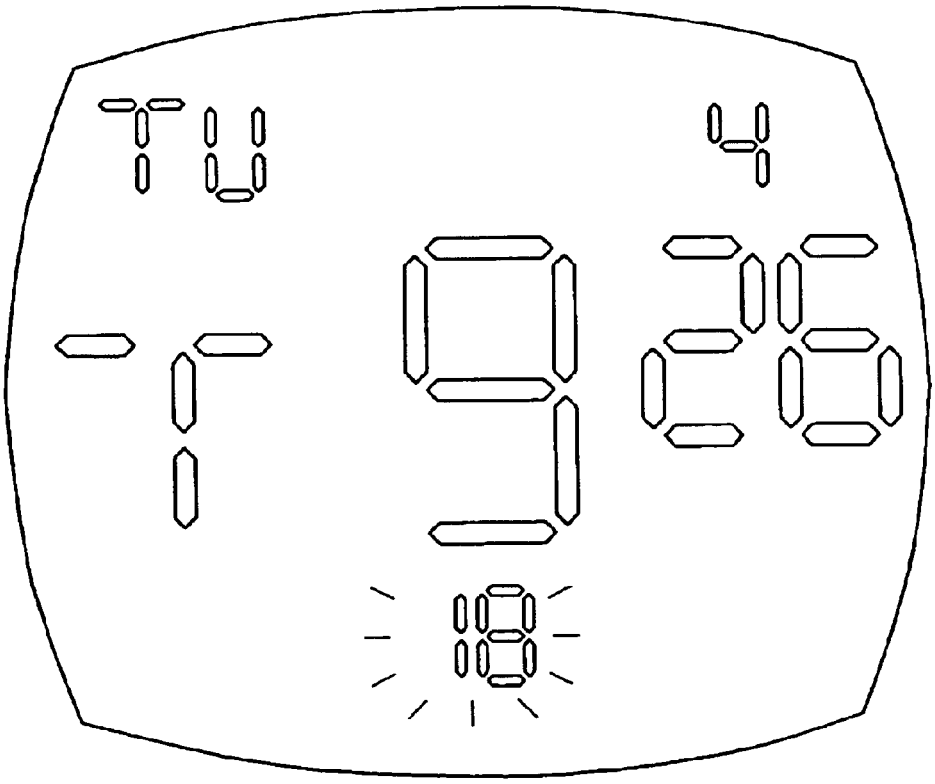
FIG. 2 is a selectively activated display derived from FIG. 1 which generates a prompt for,a real time setting mode.
Figure 5:
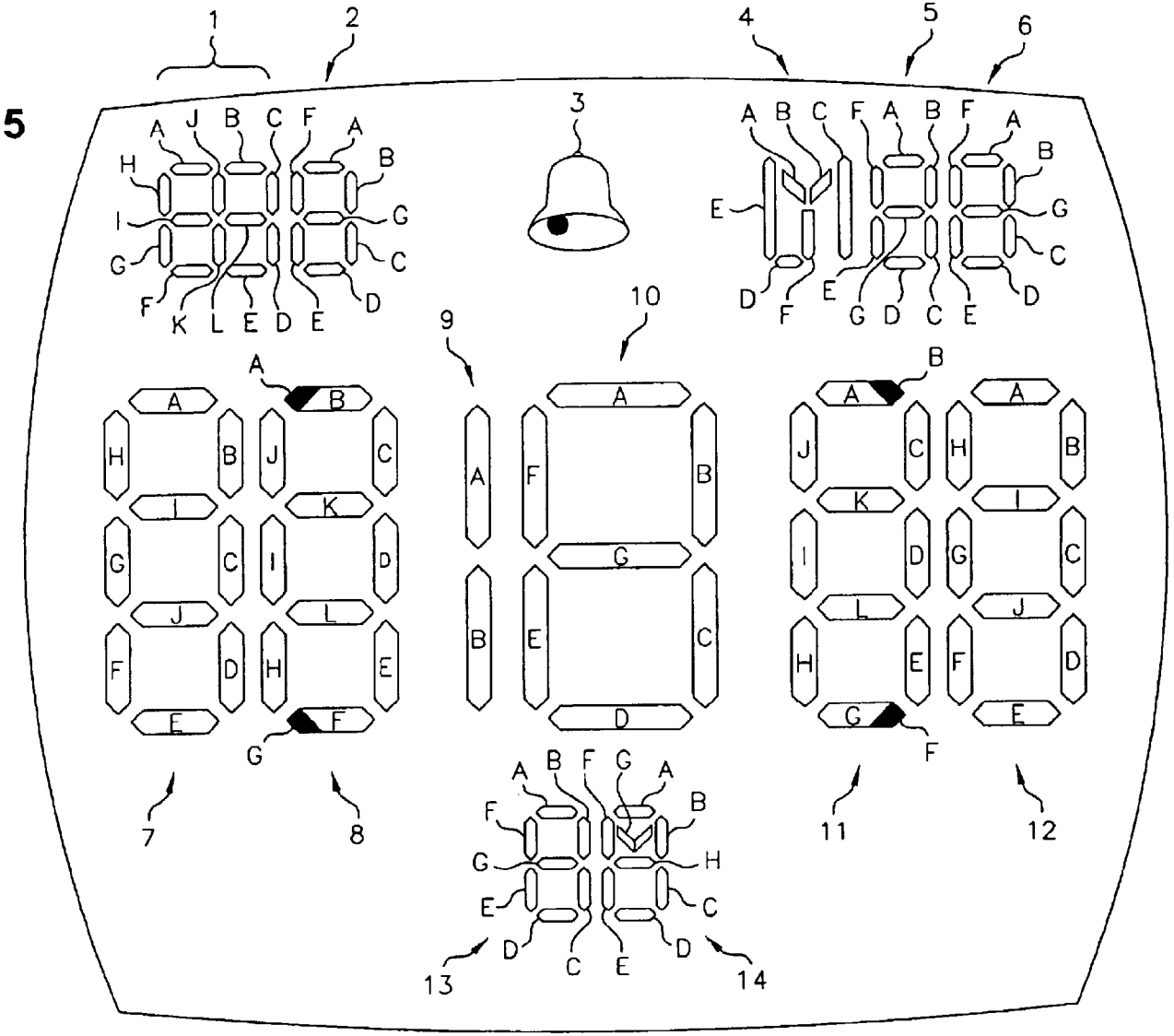
FIG. 5 is an enlarged copy of FIG. 1 with added alphanumeric labels for each digital display element.

In order to distinguish these appearances, when it is desired on any occasion to set or reset the real time values presented by such displays, the display is preferably selectively activated to generate a different display exemplified in FIG. 2. As there shown, a capital "T" is formed on the left side of hour digit 9 by selective activation of 7I, 8 KIH in sets 7 and 8 of FIG. 5. This letter T precedes the time display of 26 minutes and 18 seconds past 9, with the seconds value flashing and incrementing by one unit every half second to show that it is available for resetting to zero. The fact that it is a Tuesday dated the $4^{th}$ of a month is included in the upper horizontal region of the overall display field.

In real time, a prior art balanced display would show a similar set of real time values in the same positions, but the left side of the central 9 would be empty. In the prior art quadribalanced and enhanced quadribalanced time displays, there also would be no minutes on the left side of hour 9, and the 26 minutes would appear in a relatively lower position on the right side of hour 9 by activation of 11KDLFGH, 12IGJDEF of sets 11 and 12. This would also be true for the displays of the above-cited co-pending application.

Therefore, the display of FIG. 2 provides an immediately recognizable different appearance from any of the above-referenced real time displays. Coupled with the formation of the capital letter "T" (signifying real time setting) in the leading position on the left side of the hour, which preferably is programmed to remain activated throughout the ensuing setting or resetting procedures, FIG. 2 will be unmistakably understood by the viewer that the display has converted to a setting or resetting mode for changing the value of one or more of seconds, minutes, hours or AM/PM. Preferably that sequence is performed by use of a single crown control, as described in U.S. Pat. No. 6,286,991 B1, the disclosure of which is incorporated herein by reference.

Figure 3:
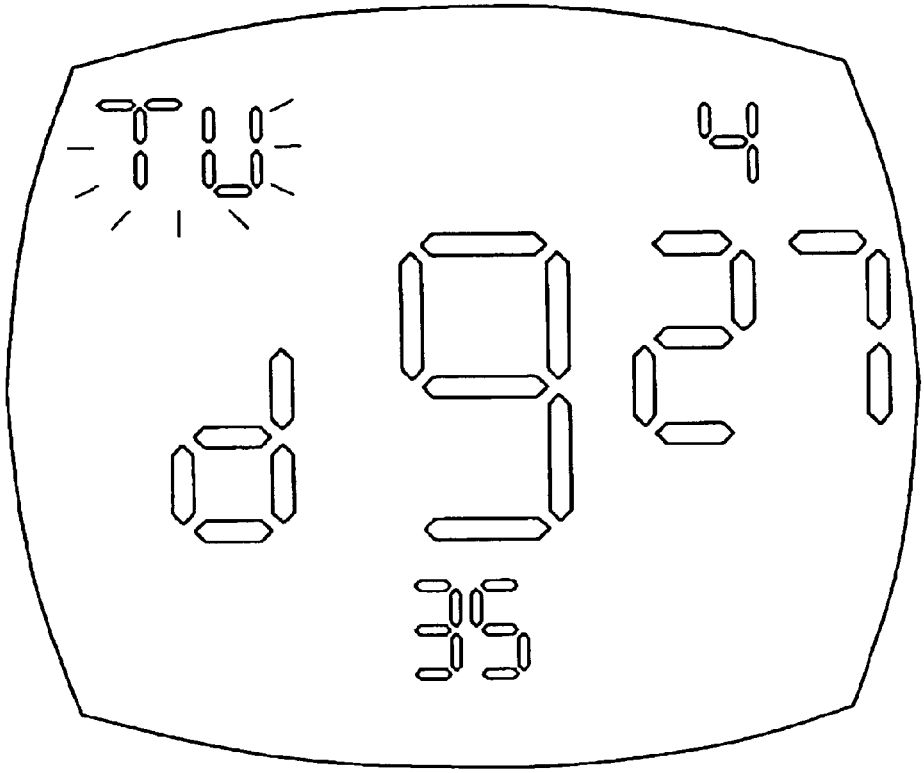
FIG. 3 is another selectively activated display derived from FIG. 1 which generates a prompt for a calendar values setting mode.

That crown control is programmed next to access calendar values in the sequence of day name and thereafter month, day and year dates. FIG. 3 is an optional display for prompting the viewer to the fact that such calendar functions are available for setting or resetting, as indicated by the lower case letter "d" (signifying day/dates settings) formed in the leading position on the left of hour digit 9 by activation of 8DEFGHL in set 8 of FIG. 5, together with the flashing of the TU abbreviation for Tuesday. Again, this display is immediately recognizable as a different appearance from a real time display of 27 minutes and 35 seconds past hour 9 presented in the manner of the previously cited prior art patents and co-pending application.

If FIG. 3 is used, preferably the letter "d" is activated to remain steady on throughout the setting sequence of all calendar functions, and preferably the date values for months, days and years are individually prompted by "M", "D" and "Y" prefixes, as described in Published Application U.S. Ser. No. 2002/0089897 A1, published Jul. 11, 2002.

Figure 4:
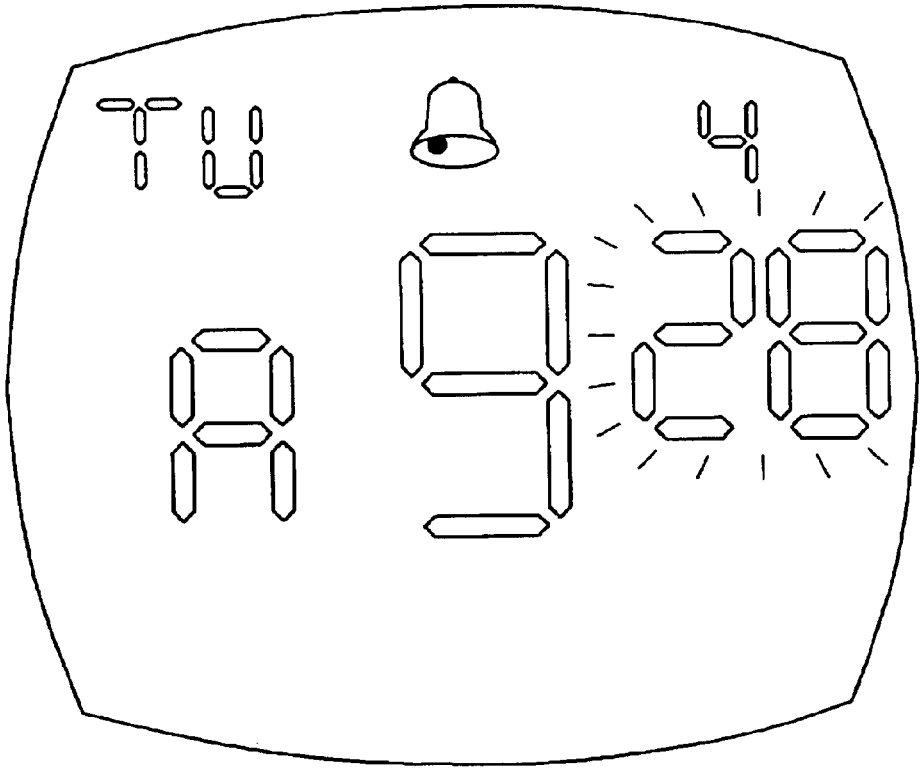
FIG. 4 is still another selectively activated display derived from FIG. 1 which generates a prompt for an alarm setting mode.

Finally, FIG. 4 is a display which prompts the viewer to the fact that the display is in an alarm setting or resetting mode. This is signified by formation of the capital letter "A" in the leading position on the left of hour 9 by activation of 8KDELHI in set 8 of FIG. 5, which letter is programmed to remain steady on throughout the ensuing setting or resetting of an alarm time. Further indications of the alarm setting mode are provided by the appearance of the bell icon of set 3 and the absence of seconds values from sets 13 and 14 of FIG. 5, since seconds are unnecessary and programmed to be at zero when selecting an alarm time by setting its hour and minutes values, using sets 9–12 of FIG. 5. Again, this figure is unmistakably different from any of the previously cited prior art and co-pending application real time displays.

The invention has now been described in terms of the preferred embodiments depicted in FIGS. 2–4. These displays provide important advantages in timepieces that operate in accordance with the teachings of the previously cited balanced, quadribalanced, enhanced quadribalanced and unidirectional segmented digital time displays. First, the prompted displays for setting or resetting real time and alarm time are all in the same format as announced correct elapsed real times given by telephone, radio or similar sources. Therefore, as earlier explained above, mental conversion of these announcements to equivalent remaining times or vice versa during second half hours is entirely eliminated.

The displays of the invention are also totally differentiated in appearance from the cited real time displays. Therefore, setting or resetting of all time and calendar functions can be readily performed without uncertainty, confusion or substantial risk of error.

The present invention may be practiced with various forms of digital display elements, e.g., LCD, LED, fluorescent, incandescent, gaseous glow or plasma discharges, or dot matrix elements that can be selectively activated, electronically or electrically, to display the time values and sequences described above.

In conclusion, the present invention has been described in terms of its general principles and specific embodiments. Many variations of such disclosure will be obvious to those skilled in the art. Accordingly, it should be understood that the ensuing claims are intended to cover all changes and modifications of the specific illustrative embodiments which fall within the literal scope of the claims and all equivalents thereof.

What is claimed is:

1. In a time display system that provides balanced, quadribalanced, enhanced quadribalanced or unidirectional segmented digital timekeeping displays, a selectively prompted display for indicating that the display is in a mode for setting or resetting real time which comprises:

(a) digital display elements activated to display the letter T in a position normally occupied by minute digits on the left side of hour digits during real time displays provided by the balanced, quadribalanced, enhanced quadribalanced or unidirectional segmented time keeping display;

(b) digital display elements activated to display a current hour on the right side of the letter T;

(c) digital display elements activated to display current elapsed minutes on the right side of the current hour; and (d) digital display elements activated to display incrementing current seconds below the current hour, whereby a viewer is prompted by the letter T to set or reset one or more of the real time values of seconds, minutes, hours and AM or PM, said prompt whenever activated becoming substituted for and in the position of normally displayed remaining minutes, coupled with a current time display during such activation consisting essentially of the existing hour on the right, existing minutes on the right of the hour and incrementally rising seconds below the hour and minutes display.

2. A selectively prompted display according to claim 1, wherein the overall sizes of the hour, minutes and seconds displays are graduated such that the hour is the largest, minutes are smaller and seconds are the smallest.

3. A selectively prompted display according to claim 2 wherein the minutes display is in a relatively upper position on the right side of the hour display.

4. A selectively prompted display according to claim 3 which includes a display of the name and date of the current day above the displays of the letter T and the current hour and minutes.

5. In a time display system that provides balanced, quadribalanced, enhanced quadribalanced or unidirectional segmented digital timekeeping displays, a selectively prompted display for indicating that the display is in a mode for setting or resetting an alarm time which comprises:

(a) digital display elements activated to display the letter A in a position normally occupied by minute digits on the left side of hour digits during real time displays provided by the balanced, quadribalanced, enhanced quadribalanced or unidirectional segmented time keeping display;

(b) digital display elements activated to display the then set alarm hour on the right side of the letter A; and (c) digital display elements activated to display the then set elapsed alarm minutes on the right side of the alarm hour; whereby a viewer is prompted by the letter A to set or reset one or more of the alarm time values of minutes, hours and AM or PM, said prompt whenever activated becoming substituted for and in the position of normally displayed remaining minutes, coupled with a current time display during such activation consisting essentially of the existing hour on the right, existing minutes on the right of the hour and incrementally rising seconds below the hour and minutes display.

6. A selectively prompted display according to claim 5, which includes an activated bell icon displayed above the displays of the letter A and the alarm hour and minutes.

7. A selectively prompted display according to claim 6 wherein the overall sizes of the alarm hour and minutes are graduated such that the alarm hour is the largest and the alarm minutes are smaller.

8. A selectively prompted display according to claim 7 wherein the alarm minutes display is in a relatively upper position on the right side of the current alarm hour display.

9. In a time display system that provides balanced, quadribalanced, enhanced quadribalanced or unidirectional segmented digital timekeeping displays, a selectively prompted display for indicating that the display is in a mode for setting or resetting calendar values which comprises:

(a) digital display elements activated to display the letter d in a position normally occupied by minute digits on the left side of hour digits during real time displays provided by the balanced, quadribalanced, enhanced quadribalanced or unidirectional segmented time keeping display;

(b) digital display elements activated to display a current hour on the right side of the letter d;

(c) digital display elements activated to display current elapsed minutes on the right side of the current hour; and (d) digital display elements activated to display an abbreviated name and the digital date of a current day, whereby a viewer is prompted by the letter d to set or reset one or more of the calendar values of day name and month, day or year dates, said prompt whenever activated becoming substituted for and in the position of normally displayed remaining minutes, coupled with a current time display during such activation consisting essentially of the existing hour on the right, existing minutes on the right of the hour and incrementally rising seconds below the hour and minutes display.

10. A selectively prompted display according to claim 9 which includes digital display elements activated to display incrementing seconds below the current hour.

11. A selectively prompted display according to claim 10 wherein the overall sizes of the hour, minutes and seconds displays are graduated such that the hour is the largest, minutes are smaller and seconds are the smallest.

12. A selectively prompted display according to claim 11 wherein the minutes display is in a relatively upper position on the right side of the hour display.

13. A selectively prompted display according to claim 12 which includes digital display elements activated to display respective prefixes of M, D and Y during the setting or resetting of the digital dates of the current month, day and year.

14. In a time display system that provides balanced, quadribalanced, enhanced quadribalanced or unidirectional segmented digital timekeeping displays, a selectively prompted display for indicating that the display is in a mode for setting or resetting real time or alarm time which comprises:

(a) digital display elements activated to display the letter T or the letter A in a position normally occupied by minute digits on the left side of hour digits during real time displays provided by the balanced, quadribalanced, enhanced quadribalanced or unidirectional segmented time keeping display;

(b) digital display elements activated to display a current hour on the right side of the letter T or the letter A; and (c) digital display elements activated to display the current elapsed minutes on the right side of the current hour; whereby (i) when the letter T is activated a viewer is prompted to set or reset one or more of the real time values of minutes, hours and AM or PM, and (ii) when the letter A is activated a viewer is prompted to set or reset one or more of the alarm time values of minutes, hours and AM or PM, said prompt whenever activated becoming substituted for and in the position of normally displayed remaining minutes, coupled with a current time display during such activation consisting essentially of the existing hour on the right, existing minutes on the right of the hour and incrementally rising seconds below the hour and minutes display.

15. Selectively prompted displays according to claim 14, which comprise additional display elements (d) activated to display incrementing current seconds below the current hour when the letter T is activated, whereby a viewer is prompted to set or reset the real time values of seconds.

16. Selectively prompted displays according to claim 15 wherein said incrementing seconds are flashed to further prompt a viewer to set or reset the real time values thereof.

17. Selectively prompted displays according to claim 15 wherein said digital display elements (a) are activatable also to display the letter d, and additional digital display elements (e) are activatable to display an abbreviated name and the digital date of a current day, whereby when the letter d is activated a viewer is prompted to set or reset one or more of the calendar values of day name and month, day or year dates.

* * * * *